US012092331B2

(12) United States Patent
Niemeyer et al.

(10) Patent No.: US 12,092,331 B2
(45) Date of Patent: Sep. 17, 2024

(54) TANGENTIAL PRESSURE ATOMIZING TIP WITHOUT FEED CHAMBER

(71) Applicants: Sander G. Niemeyer, Grand Rapids, MI (US); Alexander G. Niemeyer, Grand Rapids, MI (US)

(72) Inventors: Sander G. Niemeyer, Grand Rapids, MI (US); Alexander G. Niemeyer, Grand Rapids, MI (US)

(73) Assignee: Woodward, Inc., Fort Collins, CO (US)

( * ) Notice: Subject to any disclaimer, the term of this patent is extended or adjusted under 35 U.S.C. 154(b) by 0 days.

(21) Appl. No.: 17/993,574

(22) Filed: Nov. 23, 2022

(65) Prior Publication Data

US 2024/0167680 A1 May 23, 2024

(51) Int. Cl.

| | |
|---|---|
| ***F23R 3/14*** | (2006.01) |
| ***F23R 3/28*** | (2006.01) |
| ***F23R 3/30*** | (2006.01) |

(52) U.S. Cl.

CPC ..... *F23R 3/14* (2013.01); *F23R 3/286* (2013.01); *F23R 3/30* (2013.01)

(58) Field of Classification Search

CPC ..... F23R 3/14; F23R 3/286; F23R 3/30

See application file for complete search history.

(56) References Cited

U.S. PATENT DOCUMENTS

| | | | |
|---|---|---|---|
| 1,461,545 A | 7/1923 | Purnell | |
| 2,904,263 A | 9/1959 | Tate et al. | |
| 4,260,110 A | 4/1981 | Werding | |
| 6,186,417 B1 | 2/2001 | Ho et al. | |
| 6,289,676 B1 | 9/2001 | Prociw et al. | |
| 6,547,163 B1 * | 4/2003 | Mansour | B05B 1/3421 239/404 |
| 8,091,805 B2 | 1/2012 | Paterson | |

(Continued)

FOREIGN PATENT DOCUMENTS

| | | |
|---|---|---|
| EP | 1 793 165 A2 | 6/2007 |
| EP | 2 466 207 A2 | 6/2012 |

(Continued)

OTHER PUBLICATIONS

Woodward FST, Inc.; APS500-R Primary Circuit Tip; Reference P/N 527P899-01; Oct. 22, 2018.

(Continued)

*Primary Examiner* — William H Rodriguez

(74) *Attorney, Agent, or Firm* — Reinhart Boerner Van Deuren P.C.

(57) ABSTRACT

Embodiments of the disclosure relate to a tip for a fuel nozzle. The tip includes a tip body having a first end and a second end spatially disposed from the first end along a longitudinal axis of the tip body. A nozzle passage is disposed at the first end. An entrance cavity, a swirl chamber, and a plurality of swirl passages are disposed within the tip body. The plurality of swirl passages connects the entrance cavity and the swirl chamber. Each of the swirl passages has an opening to the entrance cavity and an exit into the swirl chamber. Fluid communication is provided from the second end to the first end such that fluid flows from the entrance cavity, through the swirl passages, into the swirl chamber, and out through nozzle passage.

19 Claims, 14 Drawing Sheets

(56) References Cited

U.S. PATENT DOCUMENTS

| | | | | |
|---|---|---|---|---|
| 8,567,198 | B2 | 10/2013 | Magni et al. | |
| 9,400,104 | B2 | 7/2016 | Low et al. | |
| 11,149,950 | B2 | 10/2021 | Niemeyer et al. | |
| 2009/0255120 | A1 | 10/2009 | McMasters et al. | |
| 2009/0256007 | A1 | 10/2009 | McMasters et al. | |
| 2014/0158796 | A1 | 6/2014 | Buelow et al. | |
| 2018/0135576 | A1 | 5/2018 | Pyle et al. | |
| 2019/0203929 | A1* | 7/2019 | Benjamin | F23R 3/286 |
| 2022/0163205 | A1* | 5/2022 | Francis | F23D 11/383 |

FOREIGN PATENT DOCUMENTS

| | | | |
|---|---|---|---|
| EP | 2940389 | A1 | 11/2015 |
| GB | 1453853 | A | 10/1976 |

OTHER PUBLICATIONS

Woodward FST, Inc.; APS500-R Primary Tip; Reference P/N 527P899-01; Mar. 15, 2004.

Figs. 4.15 and 4.16 from "Atomization and Sprays" by Arthur H. Lefebvre, p. 117, 1989, Taylor & Francis Publisher.

* cited by examiner

TANGENTIAL PRESSURE ATOMIZING TIP WITHOUT FEED CHAMBER

FIELD OF THE INVENTION

This invention generally relates to a tip of a fuel nozzle and, in particular, to a tip that does not include a feed chamber.

BACKGROUND OF THE INVENTION

Fuel injectors have been used in many applications relating to air-breathing propulsion systems, such as those used in aviation. These systems typically include a section for compressing inlet air, a combustion section for combusting the compressed air with fuel, and an expansion section where the energy from the hot gas produced by combustion of the fuel is converted into mechanical energy. The exhaust gas from the expansion section may be used to achieve thrust or as a source of heat and energy.

Such injectors typically employ a nozzle from which the fuel exits just prior to combustion. These nozzles include a tip which typically incorporates features used to promote a desired fuel droplet distribution in the fuel spray. Such features may include swirl chambers, tip geometry, atomizers, etc.

For reliable engine operation, especially in high altitude conditions, proper droplet size distribution is important to maintain. One factor relevant to maintaining proper droplet size distribution is providing a strong tangential component when the fuel is swirled prior to exiting the nozzle.

FIG. 8 depicts an example of a state-of-the-art tip 200 of a fuel nozzle that provides a strong tangential component for fuel swirled prior to exiting the nozzle. The tip 200 is shown having a two-piece construction including a tip body 202 and a swirl body 204. The tip body 202 has an interior wall 206 that defines an interior cavity 208 leading into a tip orifice 210. A tapered wall 212 may be provided between the interior wall 206 and the tip orifice 210. The swirl body 204 is disposed in the interior cavity 208 of the tip body 204. The swirl body 204 has a first exterior surface 214 and a second exterior surfacer 216. The first exterior surface 214 defines a first circumference having a size sufficient such that that the first exterior surface 214 contacts the interior wall 206 of the tip body 202. The second exterior surface 216 defines a second circumference smaller than the first circumference such that the second exterior surface 216 is radially inset from the first exterior surface 214.

When the swirl body 204 is disposed within the interior cavity 208, a feed chamber 218 is formed between the interior wall 206 and the second exterior surface 216. The feed chamber 218 provides fluid communication between a first interior cavity 220 of the swirl body 204 and a second interior cavity 222 of the swirl body 204. In particular, first flow passages 224 provide fluid communication between the first interior cavity 220 and the chamber 218, and second flow passages 226 provide fluid communication between the chamber 218 and the second interior cavity 222.

Fuel entering the tip body flows through into the first interior cavity 220 of the swirl body 204, through the first flow passages 224, and into the feed chamber 218

In certain circumstances, such tip designs may be associated with one or more of the following drawbacks. Because the annular feed chamber 218 is formed between two components (the tip body 202 and the swirl body 204), more space may be required for packaging. The tip body 202 and swirl body 204 are more difficult to machine because of the additional features required to form the feed chamber. The formation of the feed chamber between the tip body 202 and the swirl body 204 creates a potential leak path of fuel axially entering downstream of the spin chamber. Because of the additional chamber that the fuel must pass through, there is the possibility of pressure losses. Additionally, the annular feed passage is not easy to thermally insulate.

As such, there is a need in the art for an improved nozzle tip which avoids or eliminates the above drawbacks. The invention provides such a tip. These and other advantages of the invention, as well as additional inventive features, will be apparent from the description of the invention provided herein.

BRIEF SUMMARY OF THE INVENTION

Embodiments of the present disclosure provide a tip for a fuel nozzle that addresses the foregoing issues in prior tip designs. As will be discussed more fully below, the presently disclosed tips are of a single-piece or two-piece construction that eliminate the feed chamber. Instead of using a feed chamber, the tips disclosed herein include swirl passages through which fuel enters substantially axially and exits substantially tangentially into the spin chamber in fluid communication with the nozzle passage. In one or more embodiments, the one-piece tips or the components of the two-piece tips are manufactured using additive forming techniques, which allow for the formation of complex flow paths. Further, in one or more embodiments, the flow area of the swirl passages tapers between the entrance and exit so as to accelerate the fuel flowing through the passages.

Advantageously, embodiments of the tips disclosed herein provide a more compact design, are easier to machine, provide a seal between components of the two-piece construction, avoids pressure loss by eliminating the feed chamber, and reduce wall temperatures by increasing fuel velocity. These and other advantages of the disclosed tip designs, as well as additional inventive features, will be apparent from the description provided herein.

In a first aspect, the invention provides a tip for a fuel nozzle. The tip includes a tip body having a first end and a second end. The second end is spatially disposed from the first end along a longitudinal axis of the tip body. A nozzle passage is disposed at the first end. An entrance cavity is disposed within the tip body, and a swirl chamber is disposed within the tip body. A plurality of swirl passages is disposed within the tip body, and the plurality of swirl passages connects the entrance cavity and the swirl chamber. Each of the swirl passages has an opening to the entrance cavity and an exit into the swirl chamber. Fluid communication is provided from the second end to the first end such that fluid is configured to flow from the entrance cavity, through the swirl passages, into the swirl chamber, and out through nozzle passage.

In a second aspect of the tip, according to one or more embodiments, each swirl passage winds at least partially around the longitudinal axis from each respective opening to each respective exit. Further, each swirl passage imparts a flow component tangential to the swirl chamber to at least a portion of the fluid flowing through the swirl passage.

In one or more embodiments according to the second aspect, each of the plurality of swirl passages wind from 60° to 120° around the longitudinal axis.

In one or more embodiments according to the second aspect, each of the plurality of swirl passages wind at least 330° around the longitudinal axis.

In a third aspect of the tip, according to one or more embodiments, the tip has a one-piece construction, and the tip body includes an intermediate partition separating the entrance cavity from the swirl chamber. Further, the plurality of swirl passages extend through the intermediate partition.

In a fourth aspect, according to one or more embodiments of the third aspect, a wall extends from the intermediate partition toward the second end. The wall separates the entrance cavity into a first entrance cavity and a second entrance cavity. The second entrance cavity is disposed around the first entrance cavity. The plurality of swirl passages includes a first plurality of inner swirl passages and a second plurality of outer swirl passages. The first plurality of inner swirl passages provides fluid communication between the first entrance cavity and the swirl chamber, and the second plurality of outer flow passages provides fluid communication between the second entrance cavity and the swirl chamber.

In one or more embodiments according to the fourth aspect, the inner swirl passages wind from 180° to 360° around the longitudinal axis.

In one or more embodiments according to the fourth aspect, the outer swirl passages wind at least 270° around the longitudinal axis.

In one or more embodiments according to the fourth aspect, the swirl chamber has a floor and a sidewall surrounding the floor. The floor includes a frustoconical surface, and each exit of the first plurality of the inner swirl passages is formed through the frustoconical surface of the floor. Further, each exit of the second plurality of outer swirl passages is formed through the sidewall.

In one or more embodiments according to the fourth aspect, the outer swirl passages are connected to a different manifold than the inner swirl passages.

In one or more embodiments according to the second aspect, the plurality of swirl passages intersect with the swirl chamber at an angle of less than 10° relative to a transverse axis perpendicular to the longitudinal axis.

In one or more embodiments according to the second aspect, the plurality of swirl passages intersect with the swirl chamber at an angle of 45° or less relative to a transverse axis perpendicular to the longitudinal axis.

In one or more embodiments, according to any aspect described herein, each opening of the plurality of swirl passages has a first flow area, and each exit of the plurality of swirl passages has a second flow area. The second flow area is less than the first flow area.

In one or more embodiments according to the first aspect, the tip has a two-piece construction, and the tip further includes a swirl body disposed within the tip body. The swirl body has a first portion defining the swirl chamber, a second portion defining the entrance cavity, and an intermediate portion disposed between the first portion and the second portion. The plurality of swirl passages extend through the intermediate portion.

In a fifth aspect, according to one or more embodiments of the first aspect, each of the plurality of swirl passages has a first segment that extends axially toward the swirl chamber and outwardly from the longitudinal axis at a first angle formed with the longitudinal axis and a second segment that intersects with the swirl chamber and extends toward the longitudinal axis at a second angle formed with the longitudinal axis.

In one or more embodiments according to the fifth aspect, the first angle 45° or less.

In one or more embodiments according to the fifth aspect, the second angle is in a range of 30° to 90°.

In one or more embodiments, according to any aspect described herein, fluid communication is provided directly from the entrance cavity, through the plurality of swirl passages, and into the swirl chamber without an intervening feed chamber.

In one or more embodiments, according to any aspect described herein, the tip body is formed at least partially through additive manufacturing.

In one or more embodiments, according to any aspect described herein, the swirl chamber has a floor and a sidewall surrounding the floor, and each exit of the plurality of swirl passages is formed in the sidewall.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Various embodiments of the disclosure relate to a tip for a fuel nozzle without a feed chamber. The presently disclosed tips include swirl passages that extend axially through the tip and output fuel having a tangential component into the swirl chamber. In one or more embodiments, the swirl passages rotate radially around a longitudinal axis of the tip as they extend axially. In one or more other embodiments, the swirl passages are angled outwardly away from the longitudinal axis and then inwardly towards the longitudinal axis as they extend axially through the tip. Such swirl passages provide axial and tangential acceleration of the fuel within the tip, thereby allowing for a tip construction that avoids the use of an annular feed chamber. Further, as will be discussed below, the swirl passages can be formed in tips having single-piece or two-piece construction, in particular, using additive forming techniques. These and other aspects and advantages will be described more fully below and in relation to the accompanying figures. The embodiments presented are provided by way of illustration and not limitation.

Figure 1A:
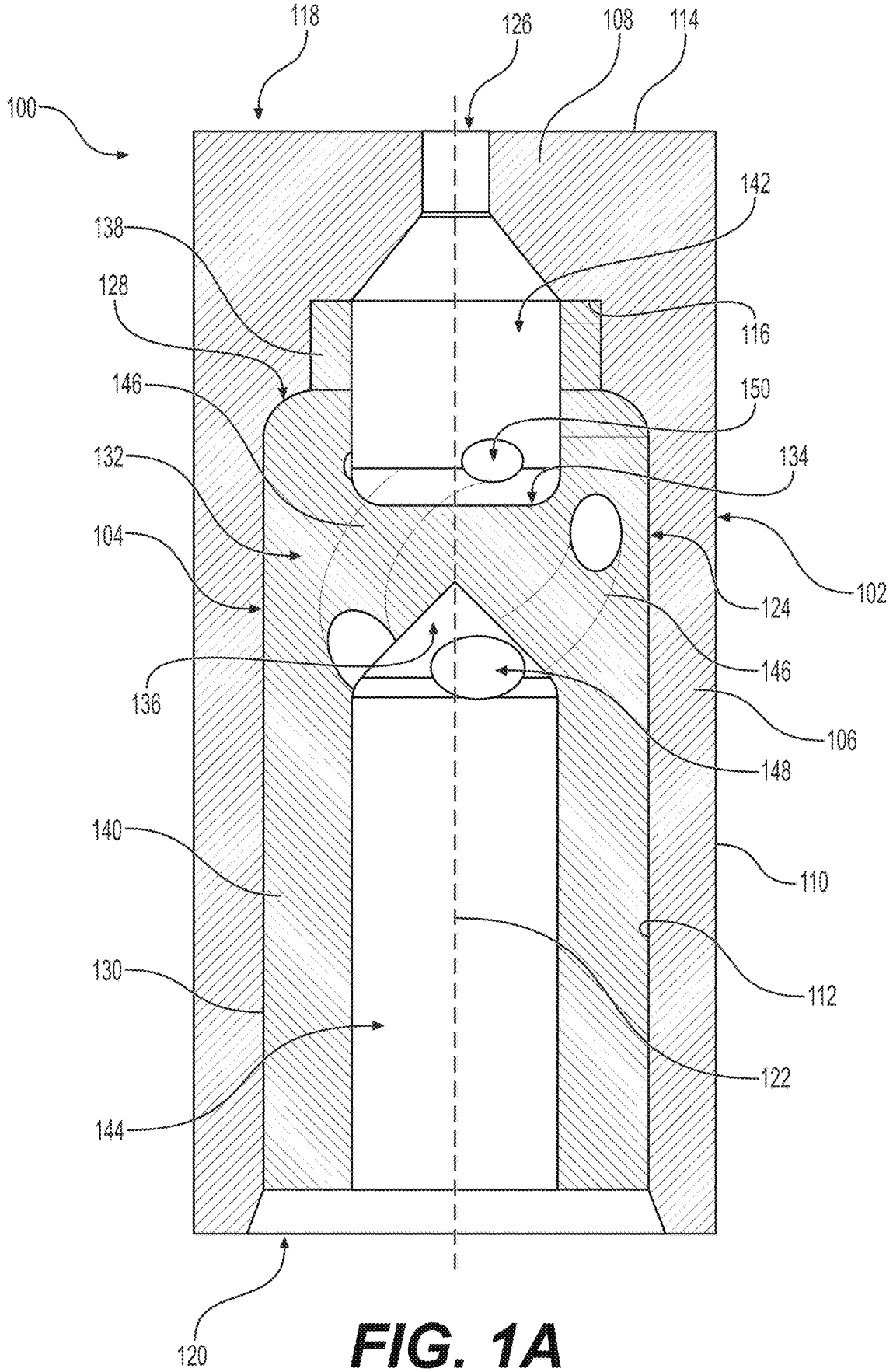
FIG. 1A depicts a tip of a fuel nozzle having a two-piece construction, according to an exemplary embodiment.

FIG. 1A depicts an embodiment of a tip 100 of a fuel nozzle. In the embodiment of FIG. 1A, the tip 100 is a two-piece construction having a tip body 102 and a swirl body 104. The tip body 102 includes a first wall 106 and a second wall 108. The first wall 106 extends between a first outer surface 110 and a first inner surface 112. The second wall 108 extends between a second outer surface 114 and a second inner surface 116. In embodiments, the first outer surface 110, the first inner surface 112, the second outer surface 114, and the second inner surface 116 may be substantially planar or may have raised or recessed portions, such as a tiered surface. For example, the second outer surface 114 is depicted as a tiered surface, with a raised central region.

The tip body 102 includes a first end 118 and a second end 120, and a longitudinal axis 122 extends through the first end 118 and the second end 120. The first wall 108 intersects with the second wall 108 at the first end 118 of the tip body 100. As shown in FIG. 1, the second wall 108 may be perpendicular to the first wall 108. In one or more embodiments, the first wall 108 is a peripheral wall, and the second wall 110 is a top wall covering the peripheral wall. In one or more embodiments, the tip body 102 is rotationally symmetric around the longitudinal axis 122. In such embodiments, the tip body 102 may be cylindrical.

The first wall 106 and the second wall 108 define a first interior cavity 124 of the tip body 102. The swirl body 104 is disposed within the first interior cavity 124. A nozzle passage 126 is formed through the second wall 110 of the tip body 102. The nozzle passage 126 is in fluid communication with the first interior cavity 124. In the embodiment depicted in FIG. 1A, the nozzle passage 126 extends from the second outer surface 114 toward the second inner surface 116.

The swirl body 104 includes a first portion 128, a second portion 130, and an intermediate portion 132. The intermediate portion 132 is disposed between the first portion 128 and the second portion 130. The intermediate portion 132 has a first side 134 and a second side 136 with the second side 136 being opposite to the first side 134. The first portion 128 has a third wall 138 that extends from the first side 134 of the intermediate portion 132, and the second portion 130 has a fourth wall 140 that extends from the second side 136 of the intermediate portion 132. In particular, the third wall 138 extends from the intermediate portion 132 in the opposite direction as the fourth wall 140. The third wall 138 defines a second cavity 142 (also referred to as the "swirl chamber" 142), and the fourth wall 140 defines a third cavity 144 (or "entrance cavity 144"). Fluid communication is provided between the third cavity 144 and the second cavity 142 by a plurality of swirl passages 146 that extend through the intermediate portion 132.

In particular, each of the swirl passages 146 has an opening 148 disposed on the second side 136 of the intermediate portion 132 and an exit 150 disposed on the first side 134 of the intermediate portion 132. In one or more embodiments, the opening 148 may be formed through an interior surface of the fourth wall 140 or through the second side 136 of the intermediate portion 132. In one or more embodiments, the exits 150 may be formed through an interior surface of the third wall 138 or through the first side 134 of the intermediate portion 132. Between the opening 148 and the exit 150 of each swirl passage 146 in the embodiment depicted, the swirl passage 146 extends longitudinally and winds at least partially around the longitudinal axis 122. In one more embodiments, a first flow area of the opening 148 is bigger than a second flow area of the exit 150. For example, the opening 148 may have a maximum cross-sectional dimension and/or cross-sectional area that is greater than a maximum cross-sectional dimension and/or cross-sectional area of the exit 150. In one or more embodiments, the cross-sectional flow area of the swirl passage 146 tapers between the opening 148 and exit 150 of different sizes. As mentioned above, the swirl passages 146 axially accelerate fuel flowing from the third cavity 144 to the second cavity 142, and further, the swirl passages 146 impart a tangential component to the fuel flow. In particular, the exits 150 into the second cavity 142 open in such a way that at least a portion of the fuel flows tangentially to the circumference of the second cavity 142.

The swirl body 104 is inserted into the tip body 102. The third wall 138 of the first portion 128 of the swirl body 104 abuts the second inner surface 116 of the tip body 102. Further, the outer surface of the swirl body 104 (at least in the first portion 128 and intermediate portion 132) is in contact with the first inner surface 112 of the tip body 102. In this way, there are no fluid chambers formed between the tip body 102 and the swirl body 104 intermediate of the swirl passages 146 and the swirl chamber 142 immediately preceding the nozzle passage 126 in contrast to certain conventional designs.

Fuel enters the second end 120 of the tip body 102 and into the third cavity 144 of the swirl body 104. From the third cavity 144, the fuel flows through the swirl passages 146 and into the swirl chamber 142. The swirl chamber 142 is in fluid communication with the nozzle passage 126, and fuel sprays out of the tip 100 through the nozzle passage 126. Because of the flow path defined by the swirl passages 146, the fuel enters the swirl passages 146 from the third cavity 144 substantially axially (i.e., in a direction within 30° of parallel to the longitudinal axis 122) and (at least a portion of the fuel) exits the swirl passages 146 into the swirl chamber 142 substantially tangential to the circumferential wall of the swirl chamber 142. The strong tangential component provided by the swirl passages 146 helps to ensure a proper droplet size distribution is maintained during fuel spray.

Figure 1B:
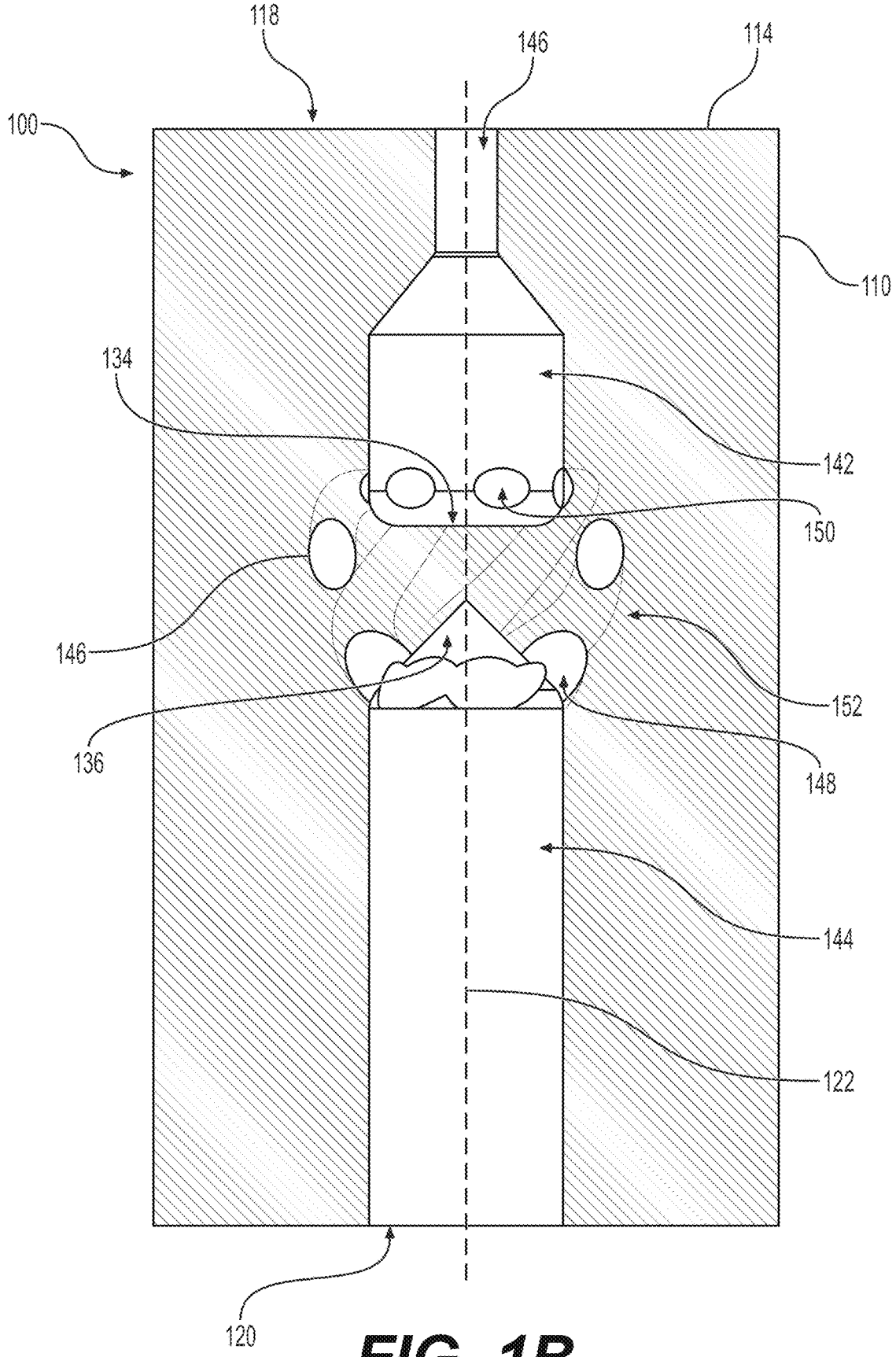
FIG. 1B depicts a tip of a fuel nozzle having a one-piece construction, according to an exemplary embodiment.

FIG. 1B depicts an embodiment of a tip 100 of a fuel nozzle having a one-piece construction including just the tip body 102. As labeled in FIG. 1B, the tip body 102 includes many of the same features contained in the embodiment of FIG. 1A. However, in the embodiment of the tip 100 of FIG. 1B, a swirl body 104 is not provided to define the second cavity 142 and the third cavity 144, and instead, the tip body 102 includes an intermediate partition 152 that divides the first interior cavity 124 into the second cavity 142 (or swirl chamber 142) and the third cavity 144. The swirl passages 146 extend through the intermediate partition 152 to connect the third cavity 144 to the second cavity 142.

As with the prior embodiment, the swirl passages 146 may be configured such that fuel enters from the third cavity 144 substantially axially and exits the swirl passages 146 into the second cavity 142 in such a manner that at least a portion of the fuel has a tangential component relative to the circumference of the second cavity 142. Further, as discussed above, the swirl passages 146 in the embodiment depicted extend longitudinally and wind at least partially around the longitudinal axis 122. Additionally, the flow area of the swirl passages 146 may taper between an opening 148 of a first flow area and an exit 150 of a second flow area that is smaller than the first flow area.

Because the tip 100 of FIG. 1B is of one-piece construction, there are no fluid chambers intermediate of the swirl passages and the nozzle passage 126 in contrast to certain conventional designs.

In operation, fuel enters the second end 120 of the tip body 102 into the third cavity 144, and from the third cavity 144, the fuel flows through the swirl passages 146 into the swirl chamber 142. The swirl chamber 142 is in fluid communication with the nozzle passage 126, and fuel sprays out of the tip through the nozzle passage 126.

Figure 2A:
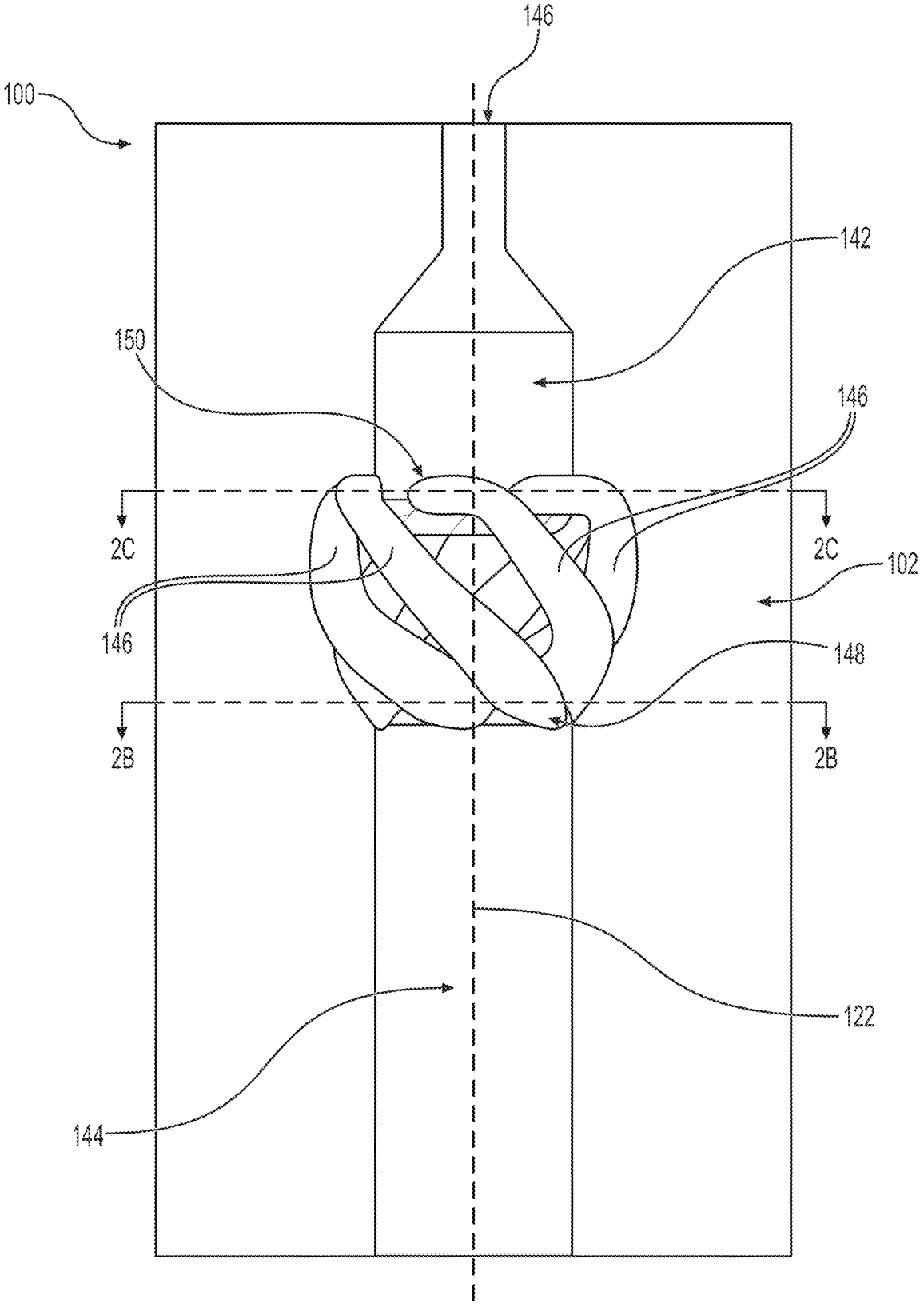
FIGS. 2A-2C depict a tip of a fuel nozzle having a one-piece construction with six swirl passages winding about 90° around the longitudinal axis of the tip, according to an exemplary embodiment.
Figure 2B:
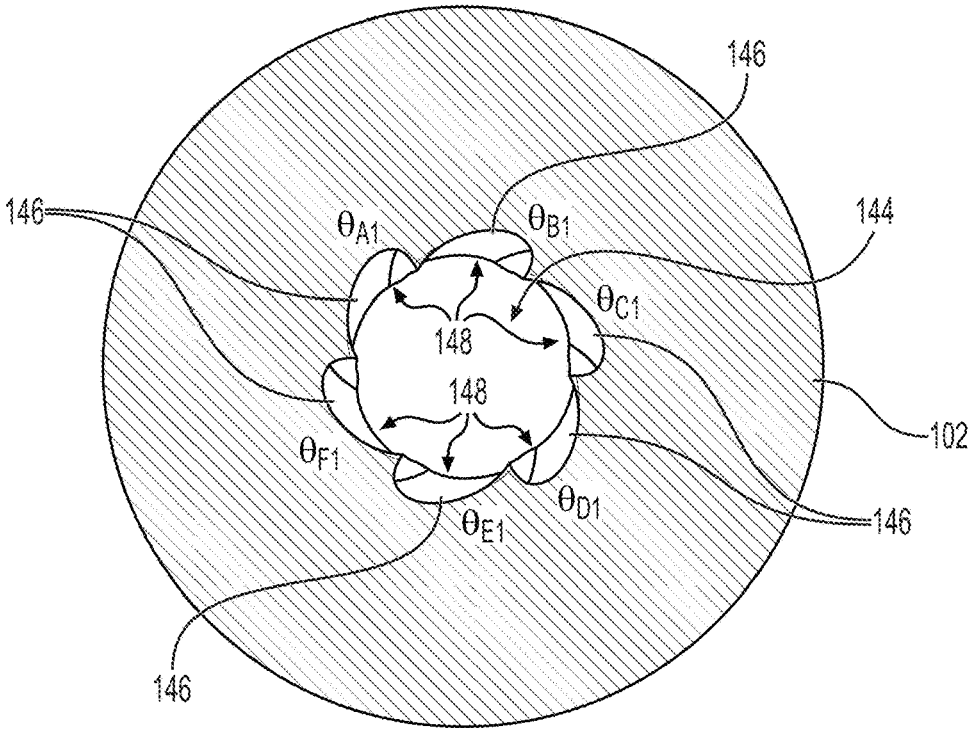
Figure 2C:
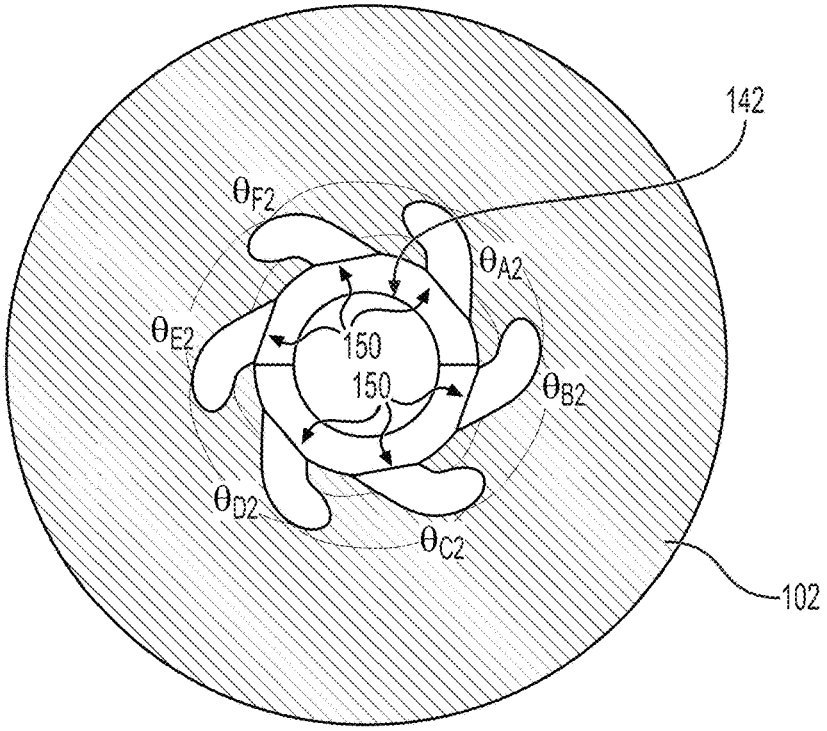

FIGS. 2A-2C depict an embodiment of a tip 100 (in particular the tip 100 of FIG. 1B) having a one-piece construction with just a tip body 102. FIG. 2A depicts a view of the flow path of the swirl passages 146 shown in phantom lines. In the embodiment depicted, there are six swirl passages 146, but the tip body 102 can include more or fewer swirl passages 146. As can be seen in FIG. 2B, the openings 148 are evenly spaced around the perimeter of the third cavity 144; however, in other embodiments, the openings 148 do not have to be evenly spaced around the perimeter of the third cavity 144. Further, as shown in FIG. 2B, the opening 148 of each swirl passage 146 is at a first angular position, and as shown in FIG. 2C, the corresponding exit 150 of the swirl passage 146 is at a second angular position. With respect to FIGS. 2B and 2C, the first angular position of each opening 148 is denoted by $\theta_{A1}$, $\theta_{B1}$, . . . $\theta_{F1}$, and the second angular position of each corresponding exit 150 is denoted by $\theta_{A2}$, $\theta_{B2}$, . . . $\theta_{F2}$. In one or more embodiments, the second angular position is rotated from the first angular position by 60° to 120°, in particular 75° to 105°. In the embodiments shown in FIGS. 2A-2C, the exit 150 of each swirl passage 146 is rotated about 90° relative to the respective opening 148 of the swirl passage 146. As can be seen in FIG. 2C, the exits 150 intersect the wall of the swirl chamber 142 in such as manner as to introduce a tangential component to at least a portion of the fuel entering the swirl chamber 142.

Figure 3A:
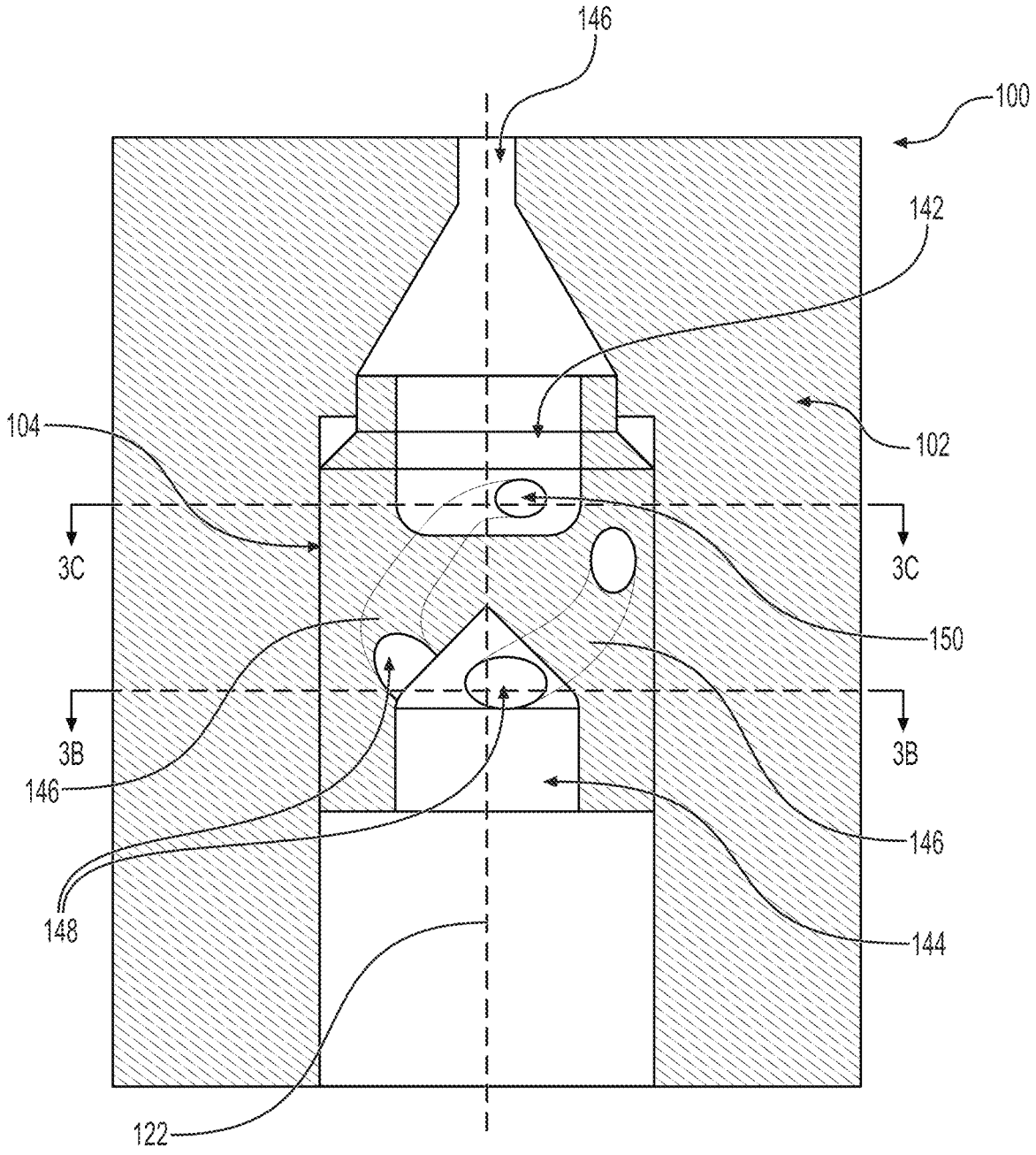
FIGS. 3A-3C depict a tip of a fuel nozzle having a two-piece construction with three swirl passages winding about 90° around the longitudinal axis of the tip, according to an exemplary embodiment.
Figure 3B:
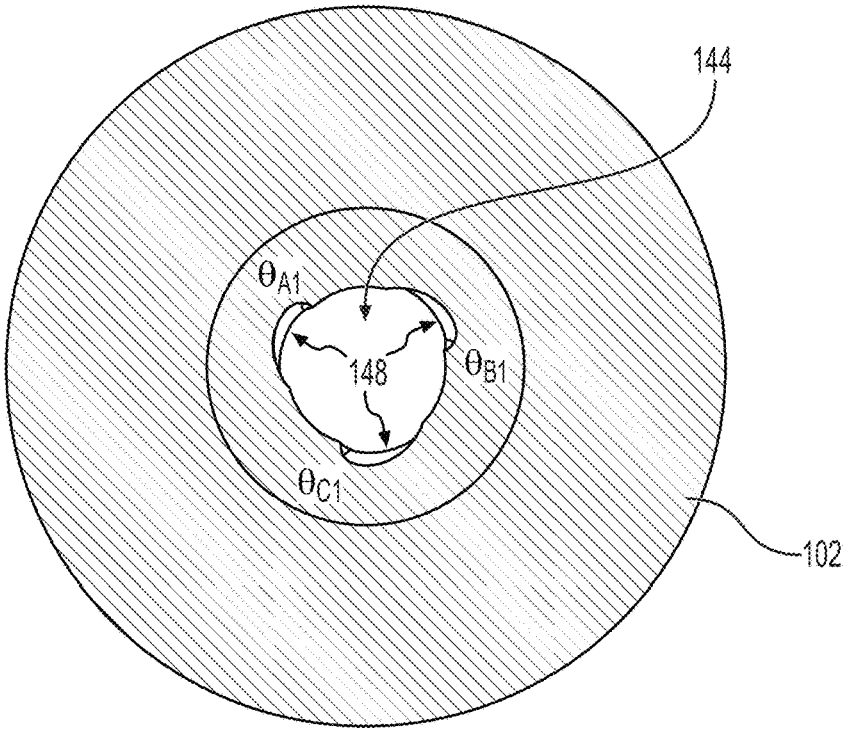
Figure 3C:
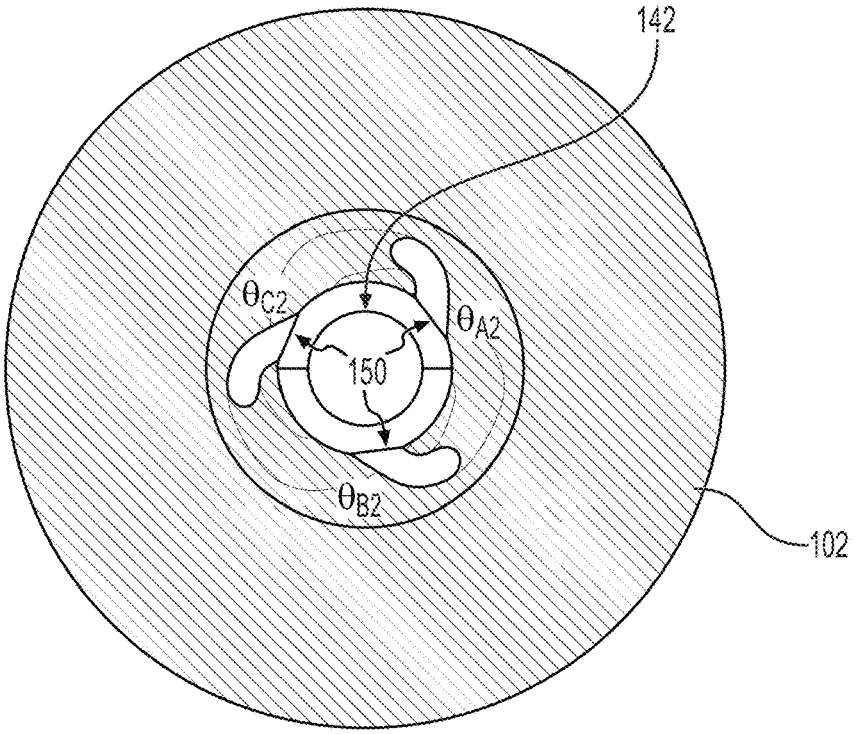

FIGS. 3A-3C depict an embodiment of a tip 100 (in particular a tip 100 similar to the embodiment depicted in FIG. 1A) having a two-piece construction including a tip body 102 and a swirl body 104. FIG. 3A depicts a partial cross-sectional view of the tip 100 with the swirl passages 146 shown in phantom lines. As can be seen in FIG. 3B, the depicted embodiment has three swirl passages 146, but in one or more other embodiments, the swirl body 104 may include more or fewer swirl passages 146. Further, in the embodiment depicted, the openings 148 are evenly spaced around the perimeter of the third cavity 144; however, in other embodiments, the openings 148 do not have to be evenly spaced around the perimeter of the third cavity 144. As shown in FIG. 3B, the opening 148 of each swirl passage 146 is at a first angular position, and as shown in FIG. 3C, the corresponding exit 150 of the swirl passage 146 is at a second angular position. With respect to FIGS. 3B and 3C, the first angular position of each opening 148 is denoted by $\theta_{A1}$, $\theta_{B1}$, $\theta_{C1}$, and the second angular position of each corresponding exit 150 is denoted by $\theta_{A2}$, $\theta_{B2}$, $\theta_{C2}$. In one or more embodiments, the second angular position is rotated from the first angular position by 60° to 120°, in particular 75° to 105°. In the embodiments shown in FIGS. 3A-3C, the exit 150 of each swirl passage 146 is rotated about 90° relative to the respective opening 148 of the swirl passage 146. Further, as can be seen in FIG. 3C, the exits 150 intersect the wall of the swirl chamber 142 in such as manner as to introduce a tangential component to at least a portion of the fuel entering the swirl chamber 142.

Figure 4A:
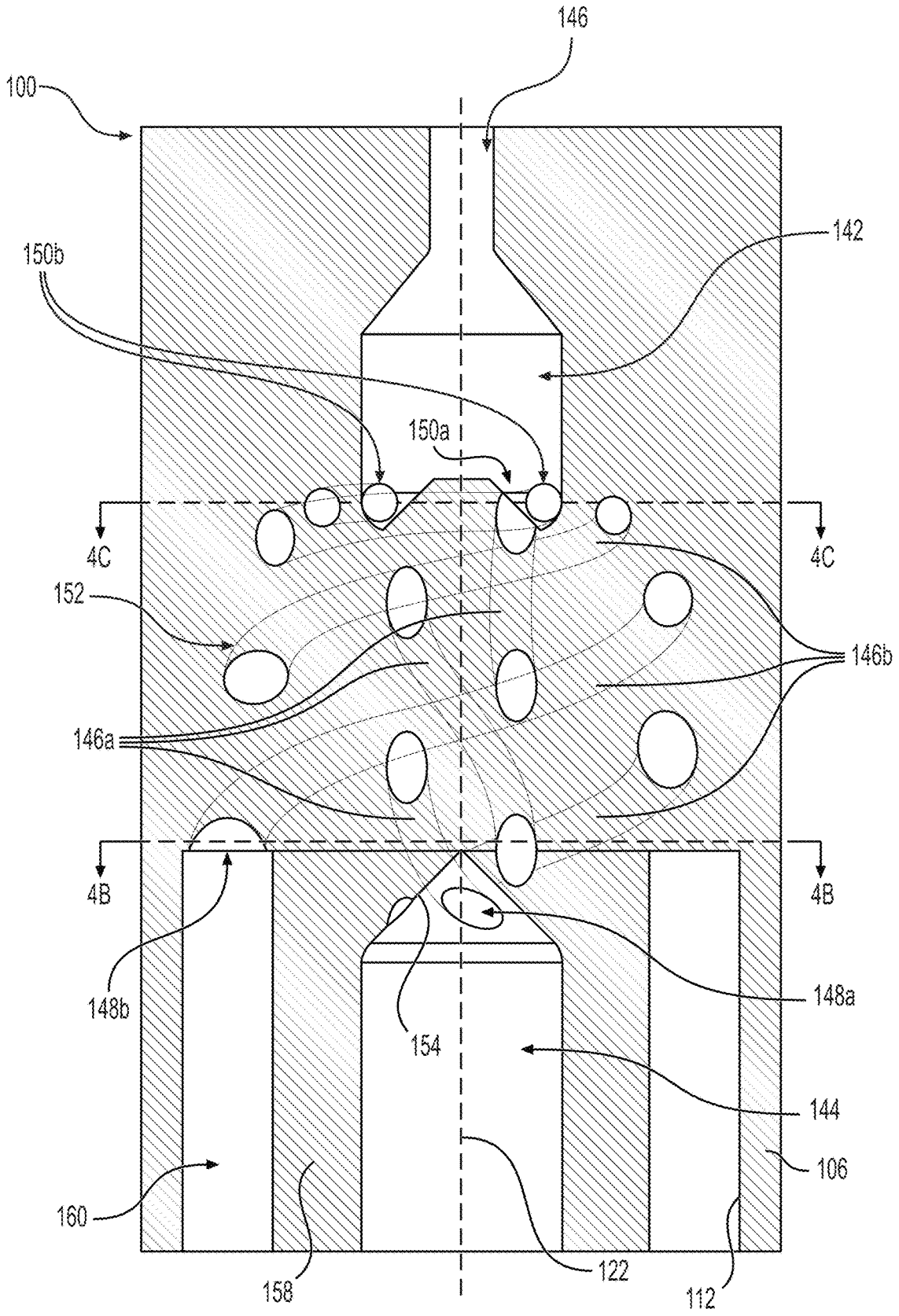
FIGS. 4A-4C depict a tip of a fuel nozzle having a one-piece construction with three inner and three outer swirl passages that wind greater than 90° around the longitudinal axis of the tip, according to an exemplary embodiment.
Figure 4B:
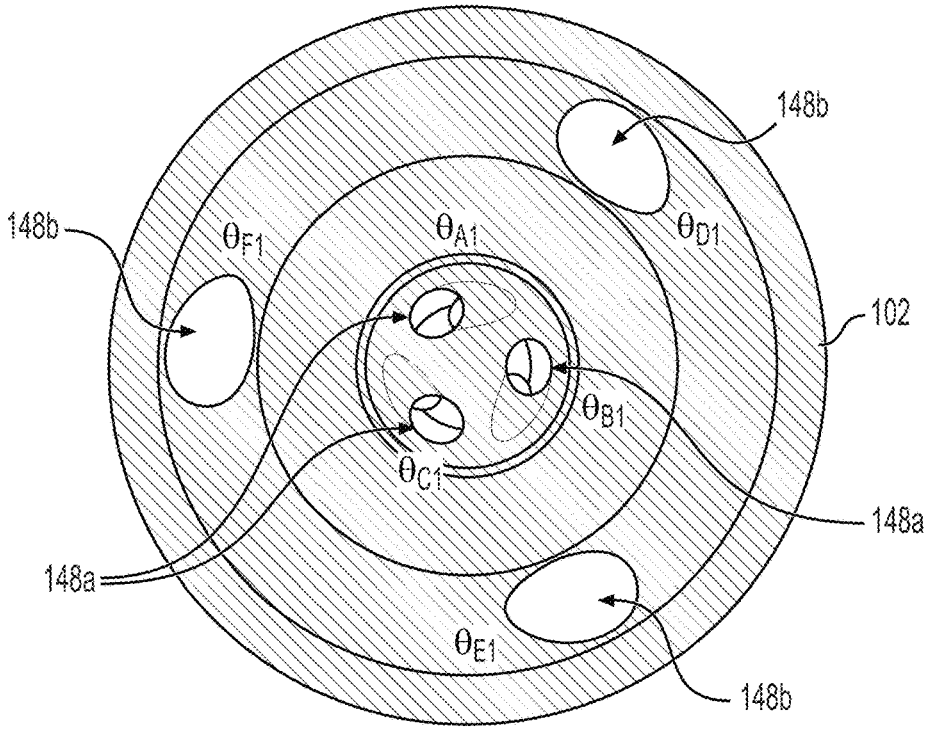
Figure 4C:
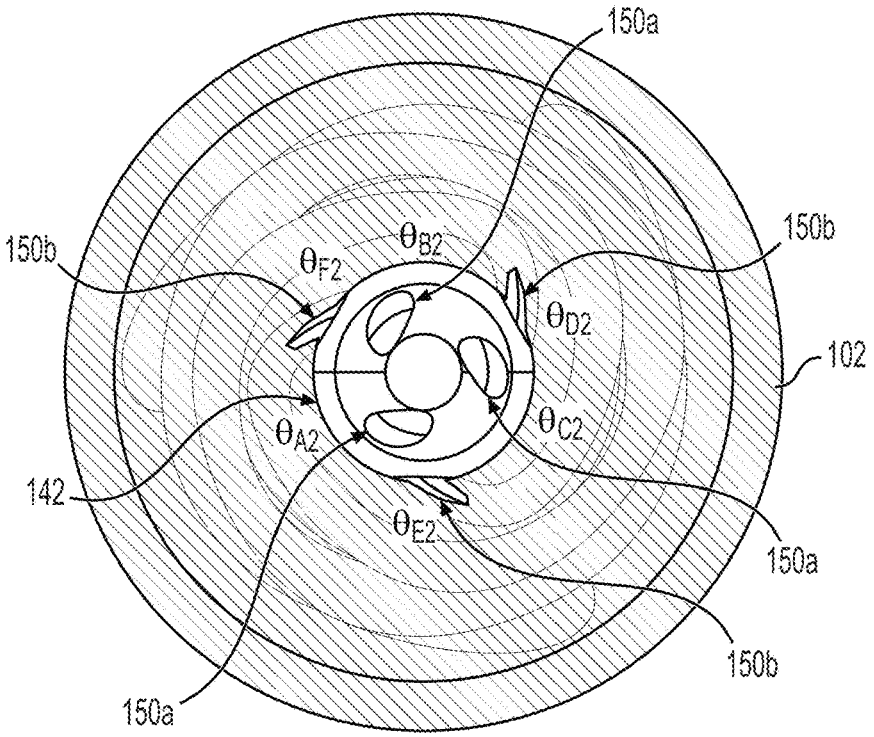

FIGS. 4A-4C depict still another embodiment of a tip 100 having a one-piece construction including just a tip body 102. In the embodiment shown in FIGS. 4A-4C, the tip body 102 has formed therein inner swirl passages 146*a* and outer swirl passages 146*b*. As can be seen in FIG. 4A, the inner swirl passages 146*a* have openings 148 that open from the third cavity 144 and exits 150 that outlet into the second cavity 142. In one or more embodiments, including the embodiment depicted, the intermediate partition 152 defines a depression having a first surface 154 at an end of the third cavity 144. In one or more such embodiments, the openings 148*a* of the inner swirl passages 146*a* open through the first surface 154 of the depression. Further, in one or more embodiments, including the embodiment depicted, the intermediate partition 152 defines a protrusion having a second surface 156 at an end of the second cavity 142. The exits 150*a* of the inner swirl passages 146*a* open through the second surface 156 of the protrusion. While FIG. 4A depicts a first surface 154 that is a conical surface and a second surface 156 that is a frustoconical surface, either surface shape could be formed on the intermediate partition 152 as well as other surface shapes, such as cylindrical, rectangular, cubic, hemispherical, pyramidical, and tetrahedral, among other possibilities.

As can be seen in FIG. 4A, a fifth wall 158 extends from the intermediate partition 152, and the fifth wall 158 is radially inset from the first inner surface 112 of the first wall 106. In this way, the intermediate partition 152, the fifth wall 158, and the first inner surface 112 defines a fourth cavity 160 that surrounds the third cavity 144. The outer swirl passages 146*b* provide fluid communication between the fourth cavity 160 and the second cavity 142. The outer swirl passages 146*b* have openings 148*b* that open through the intermediate partition 152 into the fourth cavity 160 and exits 150*b* that open into the second cavity 142. As can be seen in FIG. 4C, the exits 150*b* intersect the wall of the swirl chamber 142 in such as manner as to introduce a tangential component to at least a portion of the fluid entering the swirl chamber 142.

As shown in FIGS. 4B and 4C, the tip body 102 includes three inner swirl passages 146*a* and three outer swirl passages 146*b*. However, in other embodiments, the tip body 102 can include more or fewer inner swirl passages 146*a* and outer swirl passages 146*b*, and/or the tip body 102 may include a different number of inner swirl passages 146*a* and outer swirl passages 146*b* (e.g., may include more outer swirl passages 146*b* than inner swirl passages 146*b*).

Further, as shown in FIG. 4B, the opening 148*a* of each inner swirl passage 146*a* is at a first angular position, and as shown in FIG. 4C, the corresponding exit 150*a* of the inner swirl passage 146*a* is at a second angular position. With respect to FIGS. 4B and 4C, the first angular position of each opening 148*a* is denoted by $\theta_{A1}$, $\theta_{B1}$, $\theta_{C1}$, and the second angular position of each corresponding exit 150*a* is denoted by $\theta_{A2}$, $\theta_{B2}$, $\theta_{C2}$. In one or more embodiments, the second angular position is rotated from the first angular position by at least 90°, at least 135°, at least 180°, at least 225°, or at least 270°. In one or more embodiments, the second angular position is rotated from the first angular position by up to 360°. In the embodiments shown in FIGS. 4A-4C, the exit 150*a* of each inner swirl passage 146*a* is rotated about 270° relative to the respective opening 148*a* of the inner swirl passage 146*a*.

As also shown in FIG. 4B, the opening 148*b* of each outer swirl passage 146*b* is at a first angular position, and as shown in FIG. 4C, the corresponding exit 150*b* of the outer swirl passage 146*b* is at a second angular position. With respect to FIGS. 4B and 4C, the first angular position of each opening 148*b* is denoted by $\theta_{D1}$, $\theta_{E1}$, $\theta_{F1}$, and the second angular position of each corresponding exit 150*b* is denoted by $\theta_{D2}$, $\theta_{E2}$, $\theta_{F2}$. In one or more embodiments, the second angular position is rotated from the first angular position by at least 90°, at least 135°, at least 180°, at least 225°, or at least 270°. In one or more embodiments, the second angular position is rotated from the first angular position by up to 360°. In the embodiments shown in FIGS. 4A-4C, the exit 150*b* of each outer swirl passage 146*b* is rotated about 360° relative to the respective opening 148*b* of the outer swirl passage 146*b*.

In one or more embodiments, the inner swirl passages 146*a* and the outer swirl passages 146*b* are connected to different manifolds. In one or more embodiments, the inner swirl passages 146*a* and the outer swirl passages 146*b* carry the same or different fluids. For example, the inner swirl passages 146*a* may be connected to a primary fuel manifold, e.g., for engine ignition and low flow conditions, and the outer swirl passages 146*b* may be connected to a secondary fuel manifold, e.g., for high flow (i.e., high power) conditions. In this way, flow may be provided to either or both of the inner swirl passages 146*a* and outer swirl passages 146*b* during engine operation. In another example embodiment, one of the inner swirl passages 146*a* or the outer swirl passages 146*b* is connected to a fuel manifold, and the other of the inner swirl passages 146*a* or the outer swirl passages 146*b* is connected to a manifold providing air or water.

Figure 5A:
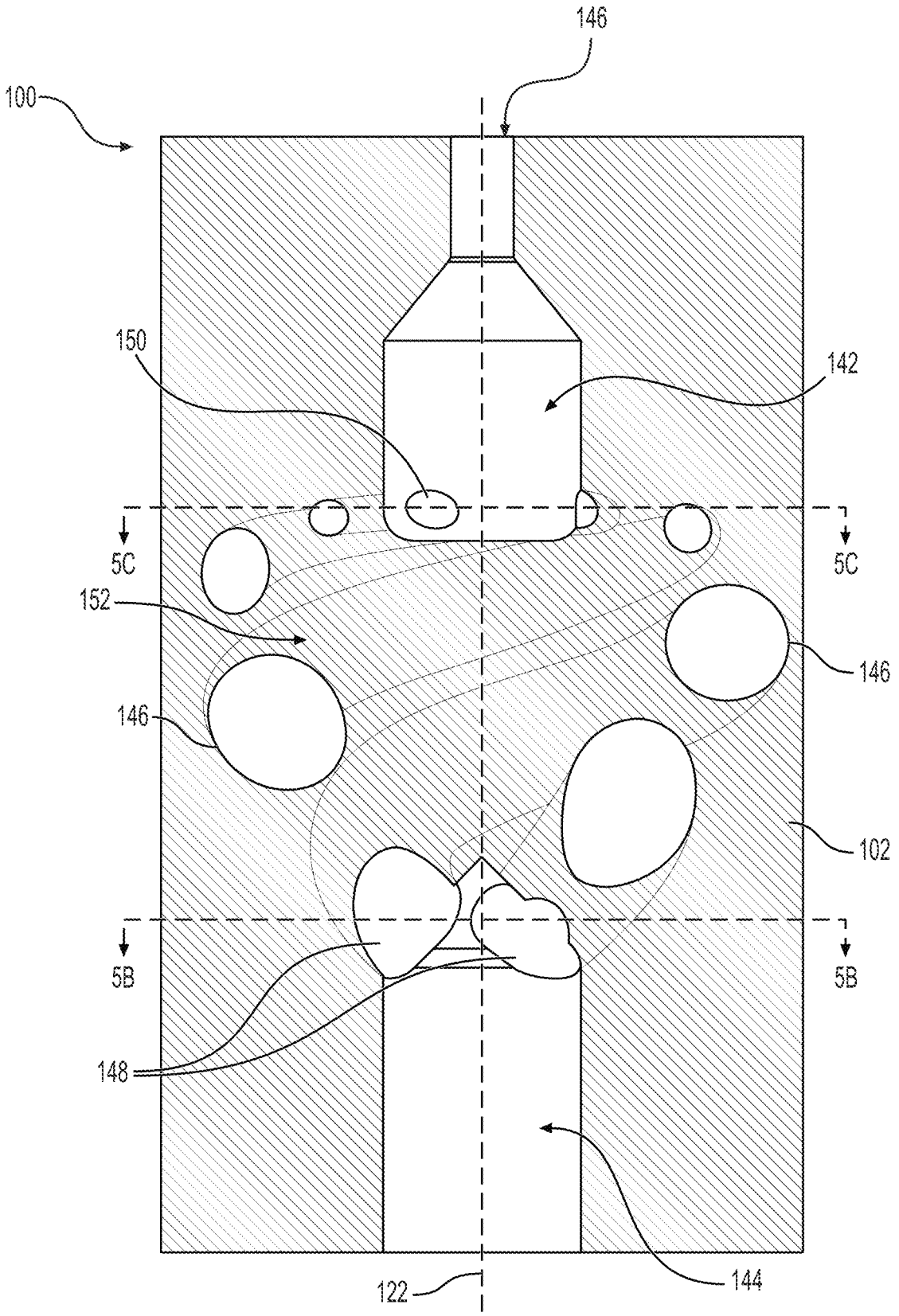
FIGS. 5A-5C depict a tip of a fuel nozzle having a one-piece construction with three swirl passages that wind about 360° around the longitudinal axis of the tip, according to an exemplary embodiment.
Figure 5B:
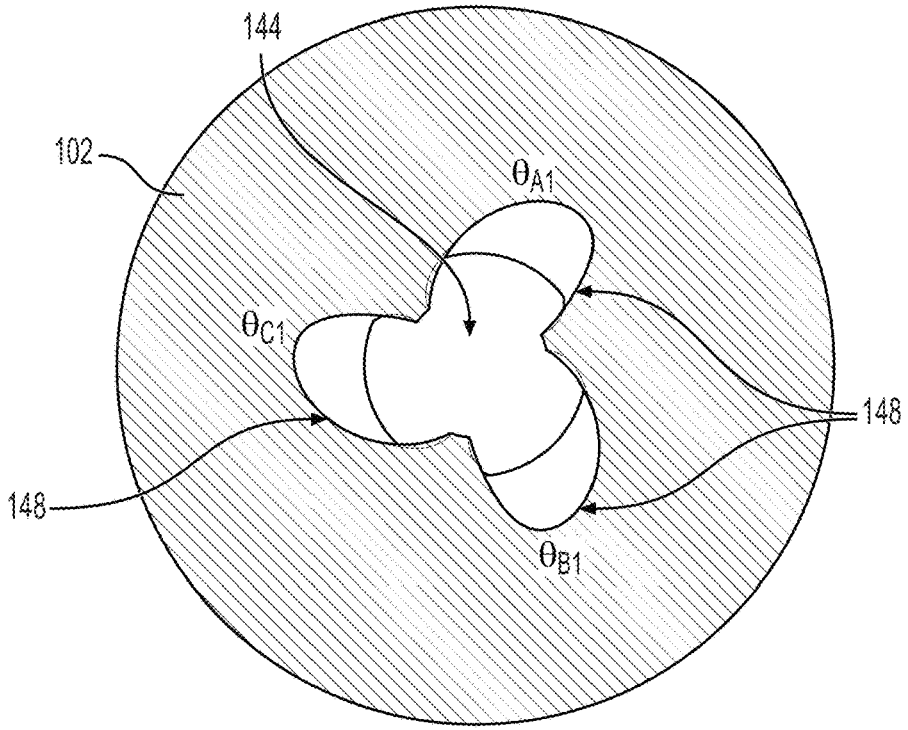
Figure 5C:
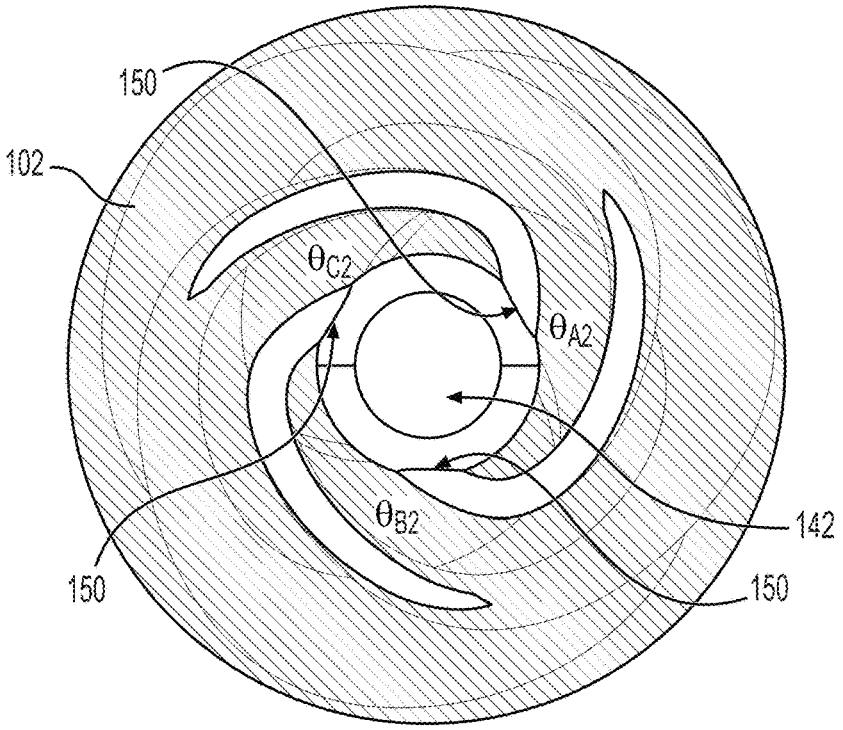

FIGS. 5A-5C depict still another embodiment of a tip 100 having a one-piece construction including just a tip body 102. FIG. 5A depicts a view of the flow path of the swirl passages 146 shown in phantom lines. In the embodiment depicted, there are three swirl passages 146, but the tip body 102 can include more or fewer swirl passages 146. As can be seen in FIG. 5B, the openings 148 are evenly spaced around the perimeter of the third cavity 144; however, in other embodiments, the openings 148 do not have to be evenly spaced around the perimeter of the third cavity 144. Further, as shown in FIG. 5B, the opening 148 of each swirl passage 146 is at a first angular position, and as shown in FIG. 5C, the corresponding exit 150 of the swirl passage 146 is at a second angular position. With respect to FIGS. 5B and 5C, the first angular position of each opening 148 is denoted by $\theta_{A1}$, $\theta_{B1}$, $\theta_{C1}$, and the second angular position of each corresponding exit 150 is denoted by $\theta_{A2}$, $\theta_{B2}$, $\theta_{C2}$. In one or more embodiments, the second angular position is rotated from the first angular position by about 360°, e.g., 330° to 390°. Thus, each swirl passage 146 makes an entire helical loop around the longitudinal axis 122. As can be seen in FIG. 5C, the exits 150 intersect the wall of the swirl chamber 142 in such as manner as to introduce a tangential component to at least a portion of the fuel entering the swirl chamber 142.

In each of the foregoing embodiments, the exit 150 of each swirl passage (or exits 150*a*, 150*b* of the inner and outer swirl passages 146*a*, 146*b*) is substantially tangential to a cross-sectional plane of the swirl chamber 142 perpendicular to the longitudinal axis 122. That is, the path of the swirl passage 146 as it winds around the longitudinal axis 122 flattens as the swirl passage 146 exits into the swirl chamber 142. In this regard, the rate of rotation of the swirl passage 146 around the longitudinal axis 122 increases in embodiments as the swirl passage 146 traverses between the opening 148 and the exit 150. As shown in the foregoing figures, this coincides with a decrease in the flow area within the swirl passage 146. Thus, as discussed above, the flow velocity is increased, and a strong tangential component to the flow is provided, which helps to form a desirable droplet size distribution in the nozzle spray.

Figure 6A:
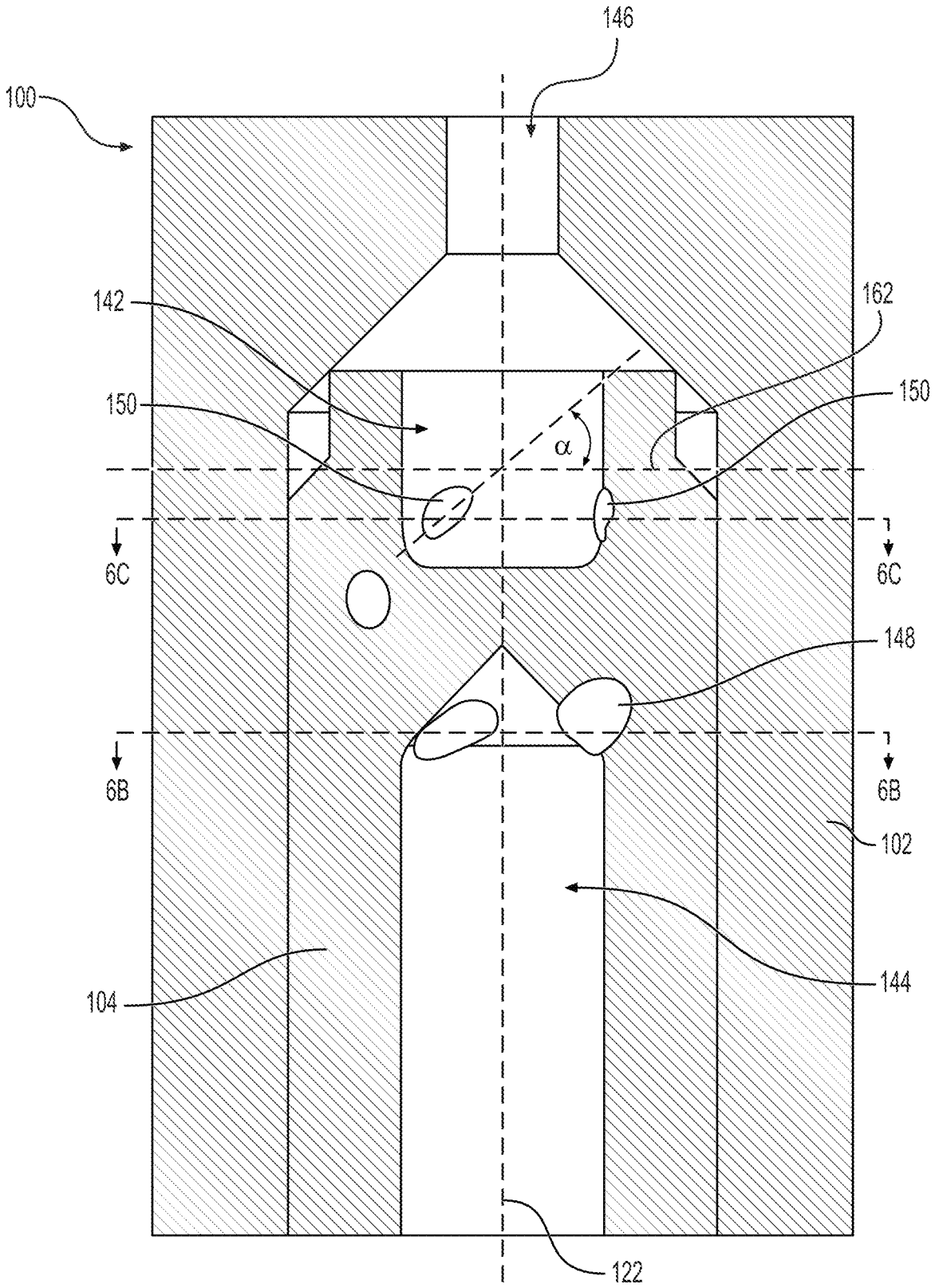
FIGS. 6A-6C depict a tip of a fuel nozzle having a two-piece construction with three swirl passages that wind about 180° around the longitudinal axis of the tip and that exit into a swirl chamber at 30° from tangent, according to an exemplary embodiment.
Figure 6B:
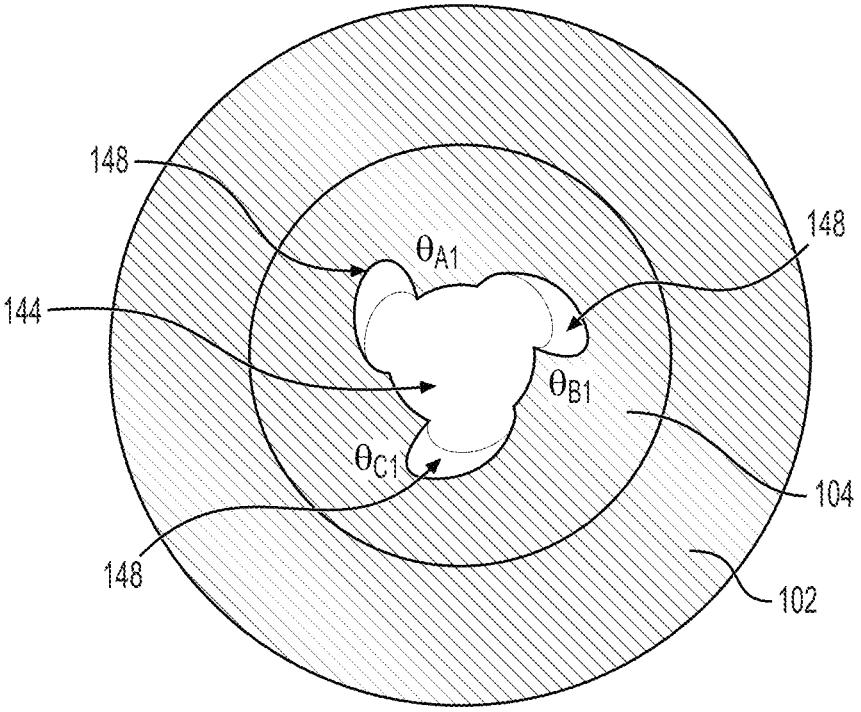
Figure 6C:
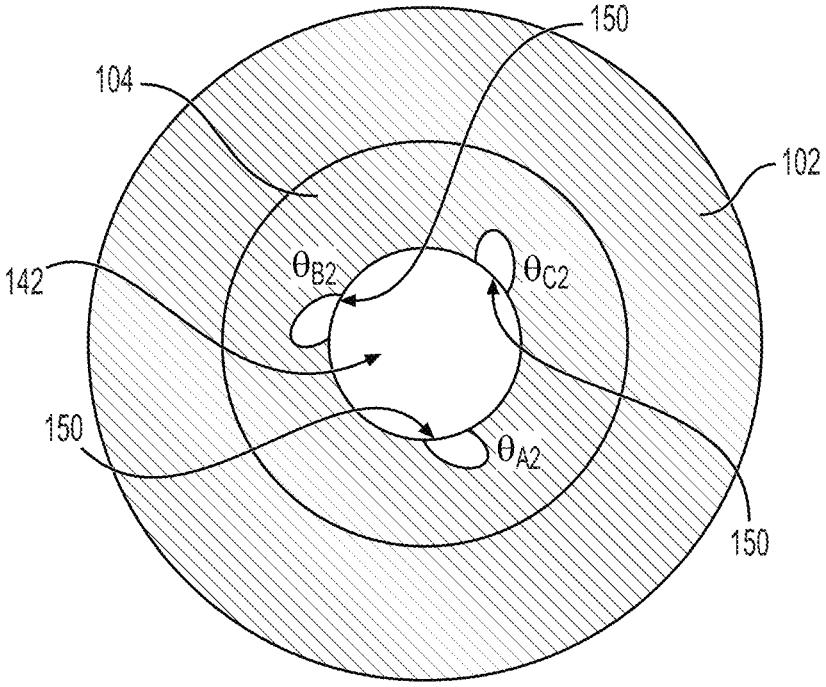

However, in one or more other embodiments, the swirl passages 146 exit into the swirl chamber 142 at an angle transverse to the cross-sectional plane. FIGS. 6A-6C depict an embodiment of a tip 100 having a two-piece construction with a tip body 102 and a swirl body 104. As can be seen in FIG. 6A, the swirl passage 146 is oriented at an angle $\alpha$ with respect to a cross-sectional plane 162 perpendicular to the longitudinal axis 122. For the previously described embodiments, the swirl passages 146 exited into the swirl chamber 142 at an angle $\alpha$ of about 0°. In one or more embodiments, including the embodiments shown in FIGS. 6A-6C, the angle $\alpha$ at which the swirl passages 146 exit into the swirl chamber 142 is 45° or less, in particular in a range of 15° to 45°. In one or more embodiments including the embodiment depicted, the swirl passage 126 exits into the swirl chamber 142 at an angle $\alpha$ of about 30°.

Besides the changed angle of exit into the swirl chamber 142, the swirl passages 146 can be as described in the previous embodiments. In particular, the swirl body 104 can include a plurality of swirl passages 146 that wind around the longitudinal axis 122 of the tip 100 from openings 148 at a first angular position to exits 150 at a second angular position. As shown in FIGS. 6B and 6C, the embodiment depicted includes three swirl passages with openings 148 at first angular positions denoted by $\theta_{A1}$, $\theta_{B1}$, $\theta_{C1}$ and exits 150 at second angular positions denoted by $\theta_{A2}$, $\theta_{B2}$, $\theta_{C2}$. In one or more embodiments, the second angular position is rotated from the first angular position by at least 90°, in particular by at least 135°. In one or more embodiments, the second angular position is rotated from the first angular position by at most 360°. In the embodiment depicted, each second angular position is rotated from each respective first angular position by about 180°.

Figure 7:
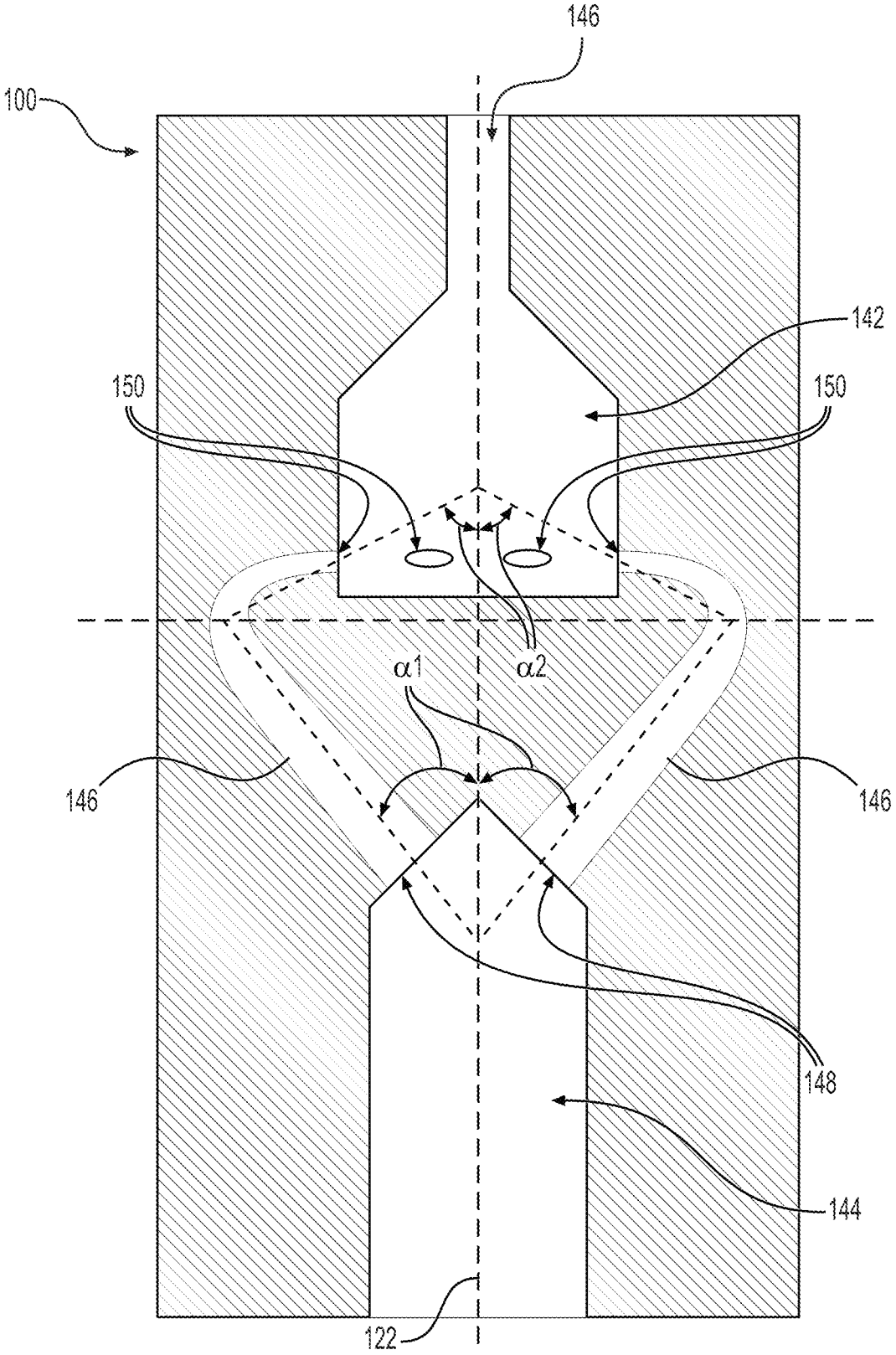
FIG. 7 depicts a cross-sectional view of a fuel nozzle having a one-piece construction with multiple swirl passages that do not wind around the longitudinal axis of the tip, according to an exemplary embodiment.
Figure 8:
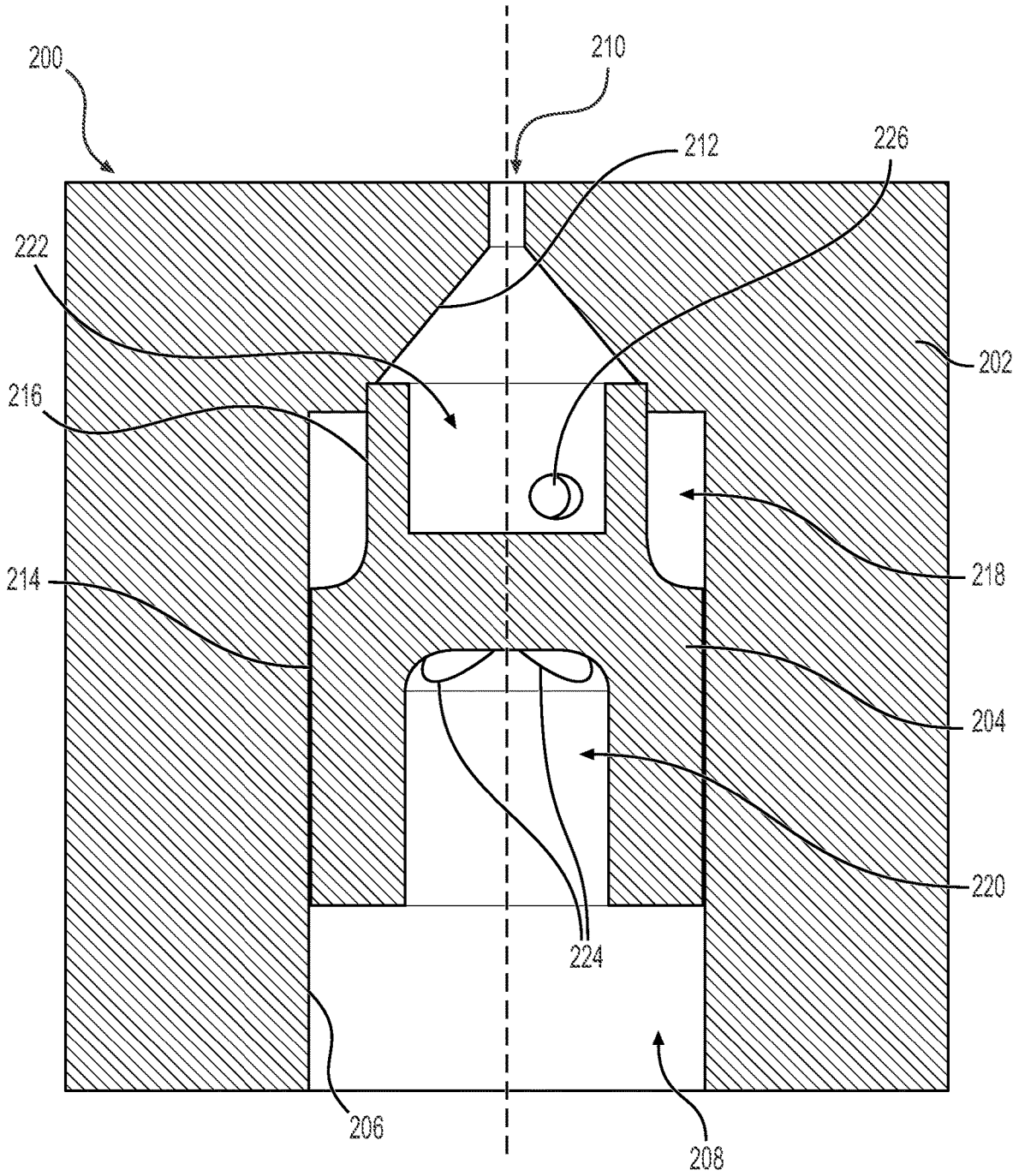
FIG. 8 (Prior Art)
FIG. 8 depicts a state-of-the-art tip of a fuel nozzle having a two-piece construction with an annular feed chamber.

FIG. 7 depicts an embodiment of a tip 100 in which the swirl passages 146 do not wind (or do not wind substantially) around the longitudinal axis 122 of the tip 100. Instead, the swirl passages 146 are angled outwardly from the longitudinal axis 122 and then angled back inwardly toward the longitudinal axis 122. As shown in FIG. 7, the swirl passages 146 having openings 148 in fluid communication with the entrance cavity 144, and the swirl passages 146 each include a first segment that extends axially toward the swirl chamber 142 and outwardly away from the longitudinal axis 122 at a first angle $\alpha_1$. Thereafter, a second segment of each of the swirl passages 146 intersects with the swirl chamber 142 such that the exits 150 of the swirl passages outlet into the swirl chamber 142, in particular in a manner that introduces a tangential component to at least a portion of the fuel. The second segments of the swirl passages 146 are, thus, angled back inwardly toward the longitudinal axis 122 at a second angle $\alpha_2$ until the swirl passages 146. As shown in FIG. 7, the swirl passages 146 taper in flow area from the openings 148 to the exits 150. In one or more embodiments, the tip 100 includes from two to eight swirl passages 146. In one or more embodiments, each of the swirl passages 146 extends outwardly away from the longitudinal axis 122, forming the first angle $\alpha_1$ with the longitudinal axis 122 in a range from 45° or less, such as in a range of 10° to 45°. In one or more embodiments, each of the swirl passages 146 extends inwardly toward the longitudinal axis 122, forming the second angle $\alpha_2$ with the longitudinal axis 122 in a range of 30° to 90°. Further, while FIG. 7 depicts a one-piece construction for this embodiment of the swirl passages 146 that do not wind around the longitudinal axis 122, such swirl passages 146 can also be used in a two-piece construction as described herein.

The foregoing embodiments are merely exemplary and should not be considered limiting. In general, embodiments of the disclosure relate to tips 100 having a one-piece (unitary) or two-piece construction in which fluid flows along the longitudinal axis 122 from the second end 120 to the first end 118. The fluid flows into the entrance cavity 144, through the plurality of swirl passages 146, into the swirl chamber 142, and out through the nozzle passage 126. The plurality of swirl passages 146 can be from two to eight swirl passages 146, in particular three to six swirl passages 146. In one or more embodiments, the swirl passages 146 wind at least partially around the longitudinal axis 122 such that the exits 150 are rotated from the openings 148. In embodiments, the exits 150 are rotated at least 60° and/or up to about 360° from the openings 148. Further, the swirl passages 146 exit into the swirl chamber 142 at various angles from substantially planarly (i.e., angle $\alpha$ 10° or less, in particular about 0°) to an angle $\alpha$ of up to 45° relative to a cross-sectional plane 162 perpendicular to the longitudinal axis 122.

In one or more other embodiments, the swirl passages 146 do not substantially wind around the longitudinal axis 122 (i.e., wind less than 90° around the longitudinal axis 122, in particular 30° or less). In such embodiments, the swirl passages 146 extend axially toward the swirl chamber 142 and outwardly away from the longitudinal axis 122 at a first angle $\alpha_1$, and along the length of the swirl passages 146, the swirl passages 146 extend back inwardly toward the longitudinal axis 122 forming a second angle $\alpha_2$. Still further, in any of the foregoing embodiments, the flow area of the swirl passages 146 can decrease from the openings 148 to the exits 150.

While embodiments of the tip 100 described herein are described as being formed through additive manufacturing, especially for the purposes of creating the complex geometries of the swirl passages 146, that should not be construed as implying that such embodiments are formed only through additive manufacturing techniques. For example, the tip 100 may be formed at least partly through additive manufacturing techniques and then finished using subtractive forming techniques, such as machining, drilling, grinding, boring, or cutting, as needed.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tip for a fuel nozzle, comprising:

a tip body having a first end and a second end, the second end spatially disposed from the first end along a longitudinal axis of the tip body;

a nozzle passage disposed at the first end an entrance cavity disposed within the tip body;

a swirl chamber disposed within the tip body;

a plurality of swirl passages disposed within the tip body, the plurality of swirl passages connecting the entrance cavity and the swirl chamber, each of the swirl passages having an opening to the entrance cavity and an exit into the swirl chamber;

wherein fluid communication is provided from the second end to the first end such that fluid is configured to flow from the entrance cavity, through the swirl passages, into the swirl chamber, and out through nozzle passage; and wherein each swirl passage winds at least partially around the longitudinal axis from each respective opening to each respective exit and wherein each swirl passage imparts a flow component tangential to the swirl chamber to at least a portion of the fluid flowing through the swirl passage.

2. The tip of claim 1, wherein each of the plurality of swirl passages wind from 60° to 120° around the longitudinal axis.

3. The tip of claim 1, wherein each of the plurality of swirl passages wind at least 330° around the longitudinal axis.

4. The tip of claim 1, wherein the tip has a one-piece construction and the tip body comprises an intermediate partition separating the entrance cavity from the swirl chamber and wherein the plurality of swirl passages extend through the intermediate partition.

5. The tip of claim 1, wherein the plurality of swirl passages intersect with the swirl chamber at an angle of less than 10° relative to a cross-sectional plane perpendicular to the longitudinal axis.

6. The tip of claim 1, wherein the plurality of swirl passages intersect with the swirl chamber at an angle of 45° or less relative to a transverse axis perpendicular to the longitudinal axis.

7. The tip of claim 1, wherein the tip has a two-piece construction and the tip further comprises a swirl body disposed within the tip body, wherein the swirl body comprises a first portion defining the swirl chamber, a second portion defining the entrance cavity, and an intermediate portion disposed between the first portion and the second portion, and wherein the plurality of swirl passages extend through the intermediate portion.

8. The tip of claim 1, wherein fluid communication is provided directly from the entrance cavity, through the plurality of swirl passages, and into the swirl chamber without an intervening feed chamber.

9. The tip of claim 1, wherein the tip body is formed at least partially through additive manufacturing.

10. The tip of claim 1, wherein the swirl chamber comprises a floor and a sidewall surrounding the floor and wherein each exit of the plurality of swirl passages is formed in the sidewall.

11. A tip for a fuel nozzle, comprising:

a tip body having a first end and a second end, the second end spatially disposed from the first end along a longitudinal axis of the tip body;

a nozzle passage disposed at the first end an entrance cavity disposed within the tip body;

a swirl chamber disposed within the tip body;

a plurality of swirl passages disposed within the tip body, the plurality of swirl passages connecting the entrance cavity and the swirl chamber, each of the swirl passages having an opening to the entrance cavity and an exit into the swirl chamber;

wherein fluid communication is provided from the second end to the first end such that fluid is configured to flow from the entrance cavity, through the swirl passages, into the swirl chamber, and out through nozzle passage;

wherein the tip has a one-piece construction and the tip body comprises an intermediate partition separating the entrance cavity from the swirl chamber and wherein the plurality of swirl passages extend through the intermediate partition; and further comprising a wall extending from the intermediate partition toward the second end, the wall separating the entrance cavity into a first entrance cavity and a second entrance cavity, the second entrance cavity disposed around the first entrance cavity, wherein the plurality of swirl passages comprises a first plurality of inner swirl passages and a second plurality of outer swirl passages, wherein the first plurality of inner swirl passages provides fluid communication between the first entrance cavity and the swirl chamber, and wherein the second plurality of outer swirl passages provides fluid communication between the second entrance cavity and the swirl chamber.

12. The tip of claim 11, wherein the inner swirl passages wind from 180° to 360° around the longitudinal axis.

13. The tip of claim 11, wherein the outer swirl passages wind at least 270° around the longitudinal axis.

14. The tip of claim 11, wherein the swirl chamber comprises a floor and a sidewall surrounding the floor, wherein the floor comprises a frustoconical surface, wherein each exit of the first plurality of the inner swirl passages is formed through the frustoconical surface of the floor, and wherein each exit of the second plurality of outer swirl passages is formed through the sidewall.

15. The tip of claim 11, wherein the outer swirl passages are connected to a different manifold than the inner swirl passages.

16. A tip for a fuel nozzle, comprising:

a tip body having a first end and a second end, the second end spatially disposed from the first end along a longitudinal axis of the tip body;

a nozzle passage disposed at the first end an entrance cavity disposed within the tip body;

a swirl chamber disposed within the tip body;

a plurality of swirl passages disposed within the tip body, the plurality of swirl passages connecting the entrance cavity and the swirl chamber, each of the swirl passages having an opening to the entrance cavity and an exit into the swirl chamber;

wherein fluid communication is provided from the second end to the first end such that fluid is configured to flow from the entrance cavity, through the swirl passages, into the swirl chamber, and out through nozzle passage; and wherein each opening of the plurality of swirl passages has a first flow area and each exit of the plurality of swirl passages has a second flow area and wherein the second flow area is less than the first flow area.

17. A tip for a fuel nozzle, comprising:

a tip body having a first end and a second end, the second end spatially disposed from the first end along a longitudinal axis of the tip body;

a nozzle passage disposed at the first end an entrance cavity disposed within the tip body;

a swirl chamber disposed within the tip body;

a plurality of swirl passages disposed within the tip body, the plurality of swirl passages connecting the entrance cavity and the swirl chamber, each of the swirl passages having an opening to the entrance cavity and an exit into the swirl chamber;

wherein fluid communication is provided from the second end to the first end such that fluid is configured to flow from the entrance cavity, through the swirl passages, into the swirl chamber, and out through nozzle passage; and wherein each of the plurality of swirl passages comprise a first segment that extends axially toward the swirl chamber and outwardly from the longitudinal axis at a first angle formed with the longitudinal axis and a second segment that intersects with the swirl chamber and extends toward the longitudinal axis at a second angle formed with the longitudinal axis.

18. The tip of claim 17, wherein the first angle is 45° or less.

19. The tip of claim 17, wherein the second angle is in a range of 30° to 90°.

* * * * *